United States Patent [19]

Kamp

[11] 4,033,104

[45] July 5, 1977

[54] METHOD AND DEVICE FOR REPLACING A SLIVER CONTAINER

[75] Inventor: Heinz Kamp, Rickelrath, Germany

[73] Assignee: W. Schlafhorst & Co., Monchen-Gladbach, Germany

[22] Filed: Aug. 16, 1976

[21] Appl. No.: 714,979

[30] Foreign Application Priority Data

Aug. 16, 1975 Germany ..... 2536435

[52] U.S. Cl. ..... 57/34 R; 19/159 A; 57/156

[51] Int. Cl.[2] ..... D01H 9/00

[58] Field of Search ..... 57/34 R, 58.89, 53, 57/156; 19/159 A

[56] References Cited

UNITED STATES PATENTS

| | | | |
|---|---|---|---|
| 3,125,782 | 3/1964 | Kaino et al. | 19/159 A |
| 3,716,979 | 2/1973 | Handschuch et al. | 57/34 R |
| 3,884,026 | 5/1975 | Yoshizawa et al. | 57/34 R |

*Primary Examiner*—Richard C. Queisser
*Assistant Examiner*—Charles Gorenstein
*Attorney, Agent, or Firm*—Herbert L. Lerner

[57] ABSTRACT

Method of replacing a sliver container in a spinning machine formed of a plurality of individual spinning stations, sliver containers being disposed in tandem in two rows by means of a transporting device carrying a limited supply of the containers and being constrained to travel on a given travel path along the spinning machine, which includes disposing at the spinning machine a respective pair of sliver containers in tandem on a carriage or slide movable transversely to the given travel path of the transporting device, loading the transporting device with filled sliver containers at one end of the spinning machine and unloading the transporting device of exchanged sliver containers at the same one end of the spinning machine or at the other end thereof, shuttling the transporting device back and forth, ready for operation past the spinning stations of the spinning machine after the transporting device has been loaded with filled sliver containers, stopping the transporting device in front of a sliver container of a respective spinning station in response to a signal from the respective spinning station that sliver is missing from the respective sliver container and performing the following operations: drawing the carriage or slide up from a working station thereof to the level of the supply of containers on the transporting device, selecting the container with missing sliver that is to be replaced, replacing the container with missing sliver by a container filled with sliver, feeding a starting end of the sliver from the container filled with sliver to a sliver guide of the respective spinning station, returning the carriage or slide to device along the given travel path thereof; and device for carrying out the foregoing method.

7 Claims, 8 Drawing Figures

11
176
177
182'
170
169
171
184
183
192
219
132
133
102
91
208
197
209
206
202
205
207
211
97
229
213
193
185
210
214
217
216
190
191
121
120
53
112
118
188
173
186
187
56
55
220
221
179
50'
87
54
215'
223
222
226
50
84
95
94
98
93
215
212

METHOD AND DEVICE FOR REPLACING A SLIVER CONTAINER

The invention relates to a method and device for replacing a sliver container of a spinning machine composed of individual spinning stations, the sliver containers being disposed in tandem in two rows, the replacement being effected by means of a transporting device constrained to travel on a given travel path along the spinning machine.

In spinning machines, empty sliver containers are conventionally replaced manually be full ones. The servicing time required therefor is quite considerable and increases further with respect to the spinning time because the running time of the sliver provided in a respective container becomes shorter and shorter with modern spinning machines. This is caused by the increasing operating speed of the machines and the decreasing working width of the individual spinning station. This limits the size of the sliver containers. Especially with coarse yarns, very short running times are attained between the individual replacement operations. A disadvantage is also the continuous monitoring of all spinning stations of a spinning machine or machine group, because the sliver containers run empty at unprogrammable times, and also disturbances in the feeding of the sliver can occur, which necessitate a container replacement before the container is completely empty. In the servicing paths or aisles between the spinning machines, full sliver containers must therefore be kept in reserve continuously, the replacement operations being therefore rendered even more difficult because of the restricted space resulting therefrom.

It is accordingly an object of the invention to provide a method of replacing a sliver container in accordance with the invention which avoids the disadvantages mentioned hereinbefore and speeds up or accelerates and automates the replacement of the sliver containers.

With the foregoing and other objects in view, there is provided in accordance with the invention, a method of replacing a sliver container in a spinning machine formed of a plurality of individual spinning stations, the sliver containers being disposed in tandem in two rows by means of a transporting device carrying a limited supply of the containers and being constrained to travel on a given travel path along the spinning machine, which comprises disposing at the spinning machine a respective pair of sliver containers in tandem on a carriage or slide movable transversely to the given travel path of the transporting device, loading the transporting device with filled sliver containers at one end of the spinning machine and unloading the transporting device of exchanged sliver containers at the same one end of the spinning machine or at the other end thereof, shuttling the transporting device back and forth, ready for operation past the spinning stations of the spinning machine after the transporting device has been loaded with filled sliver containers, stopping the transporting device in front of a sliver container of a respective spinning station in response to a signal from the respective spinning station that sliver is missing from the respective sliver container, and performing the following operations: drawing the carriage or slide up from a working station thereof to the level of the supply of containers on the transporting device, selecting the container with missing sliver that is to be replaced, replacing the container with missing sliver by a container filled with sliver feeding a starting end of the sliver from the container filled with sliver to a sliver guide of the respective spinning station, returning the carriage or slide to the working station thereof, and resuming travel of the transporting device along the given travel path thereof.

In accordance with another aspect of the invention, there is provided a device for carrying out a method of replacing a sliver container in a spinning machine formed of a plurality of individual spinning stations, sliver containers being disposed in tandem in two rows by means of a transporting device carrying a limited supply of the containers and being constrained to travel on a given travel path along the spinning machine, comprising carrying means disposed at the spinning machine for receiving thereon respective pairs of sliver containers disposed in tandem, the means being movable transversely to the given travel path of the transporting device.

In accordance with another feature of the invention, the device includes shifting means on the transporting device for moving the container carrying means.

The feed of filled sliver containers is advantageously effected from the narrow side of the spinning machine, so that the servicing aisles, for optimum utilization of the placement area or space, can be kept as narrow as possible. In accordance with further features of the invention, therefore, a loading station is provided at one end of the spinning machine for loading filled sliver containers on the transporting device, and an unloading device at either the one end or the other end of the spinning machine for unloading replaced containers from the transporting device.

The exchanging or replacing operation should proceed with as little delay as possible. The starting end of the sliver should therefore not be sought out in the newly supplied sliver containers first at the spinning station or by means of special devices of the spinning station. For this purpose, in accordance with an additional feature of the invention, holding and transfer means are provided on the transporting device for holding and transferring a starting end of a sliver to a sliver guide of a respective spinning station at which a sliver container is being replaced. During the replacement operation, not only the filled sliver containers, but also, simultaneously, the starting ends of the slivers are transferred to the spinning stations being serviced.

Due to chance and climatic conditions, the fiber sliver containers area filled to different levels. In most cases, the filling charge of sliver protrudes to a greater or lesser extent from the container. In order, therefore, to avoid the trouble caused by overfilled containers also, in accordance with a concomitant feature of the invention, means are provided at the loading station for sensing fullness of sliver in the respective containers and for rejecting overfilled sliver containers.

Upon receiving the signal "sliver missing", the sliver container is replaced, regardless of whether or not any sliver remains in the container. The decision regarding the further use of any remaining sliver is not made at the spinning station. Consequently, intervention into or interference with the exchanging or replacing operation and the time delay related thereto are thereby avoided.

The advantages attained with the invention are, in particular, that the replacement or exchange of the fiber sliver containers is effected completely automatically, delays are minimized as much as possible, and error sources are eliminated.

Other features which are considered as characteristic for the invention are set forth in the appended claims.

Although the invention is illustrated and described herein as embodied in method and device for replacing a sliver container, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing, in which.

Figure 1:
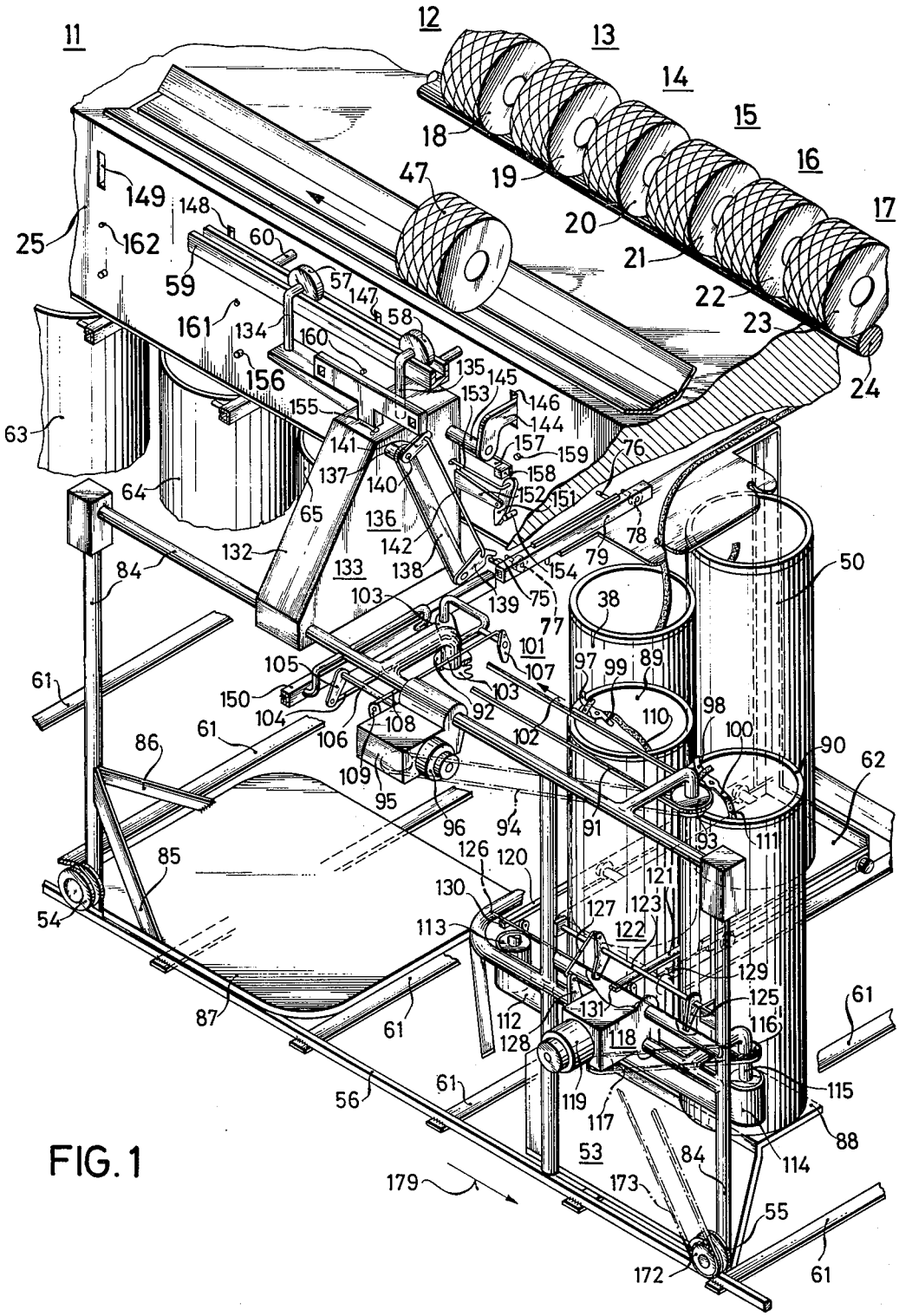
FIG. 1 is a perspective view of part of a spinning machine in which the device for replacing a sliver container is incorporated.
Figure 2:
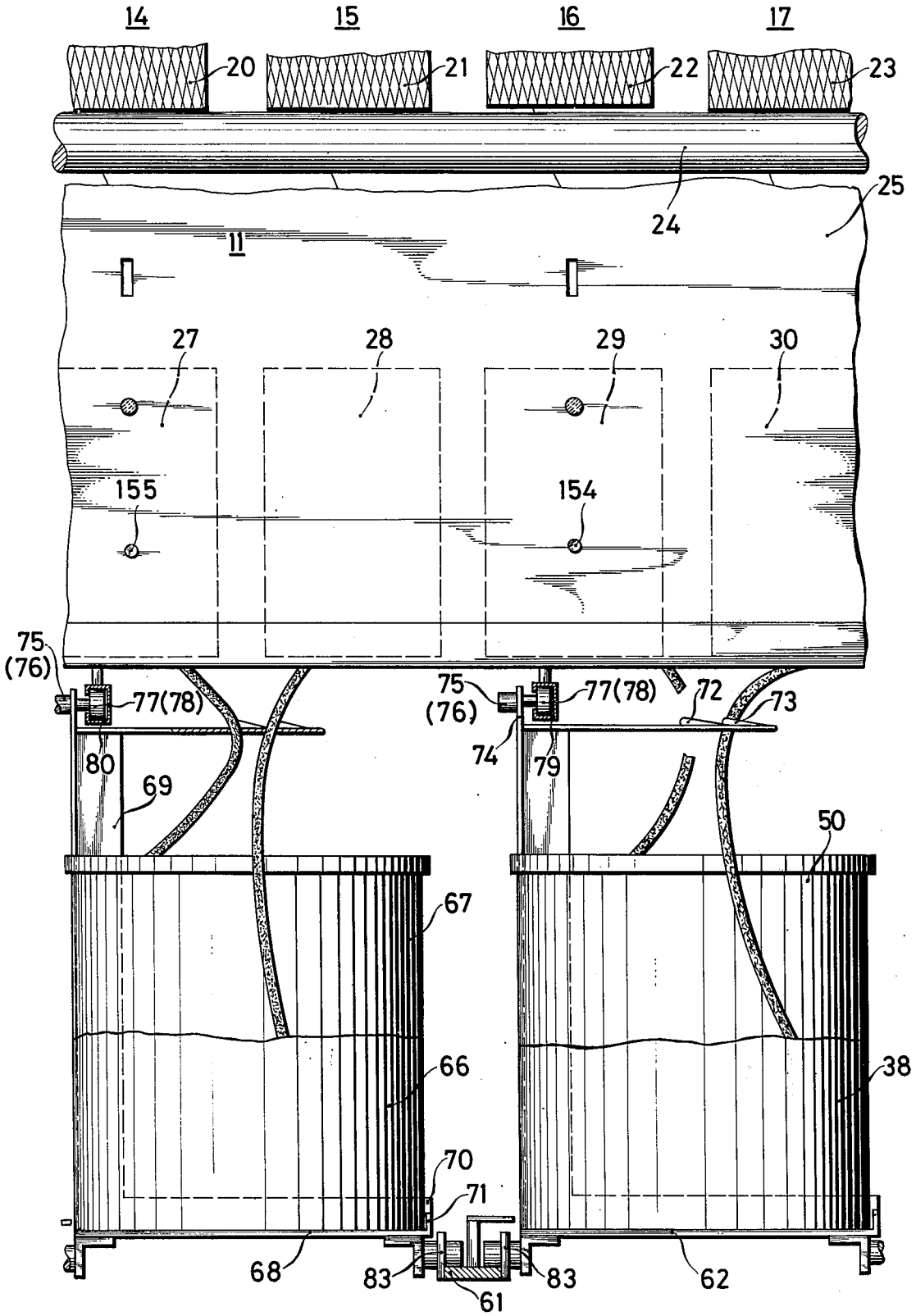
FIG. 2 is an enlarged fragmentary elevational view of FIG. 1 as seen from the upper right-hand corner to the lower left-hand corner thereof.
Figure 3:
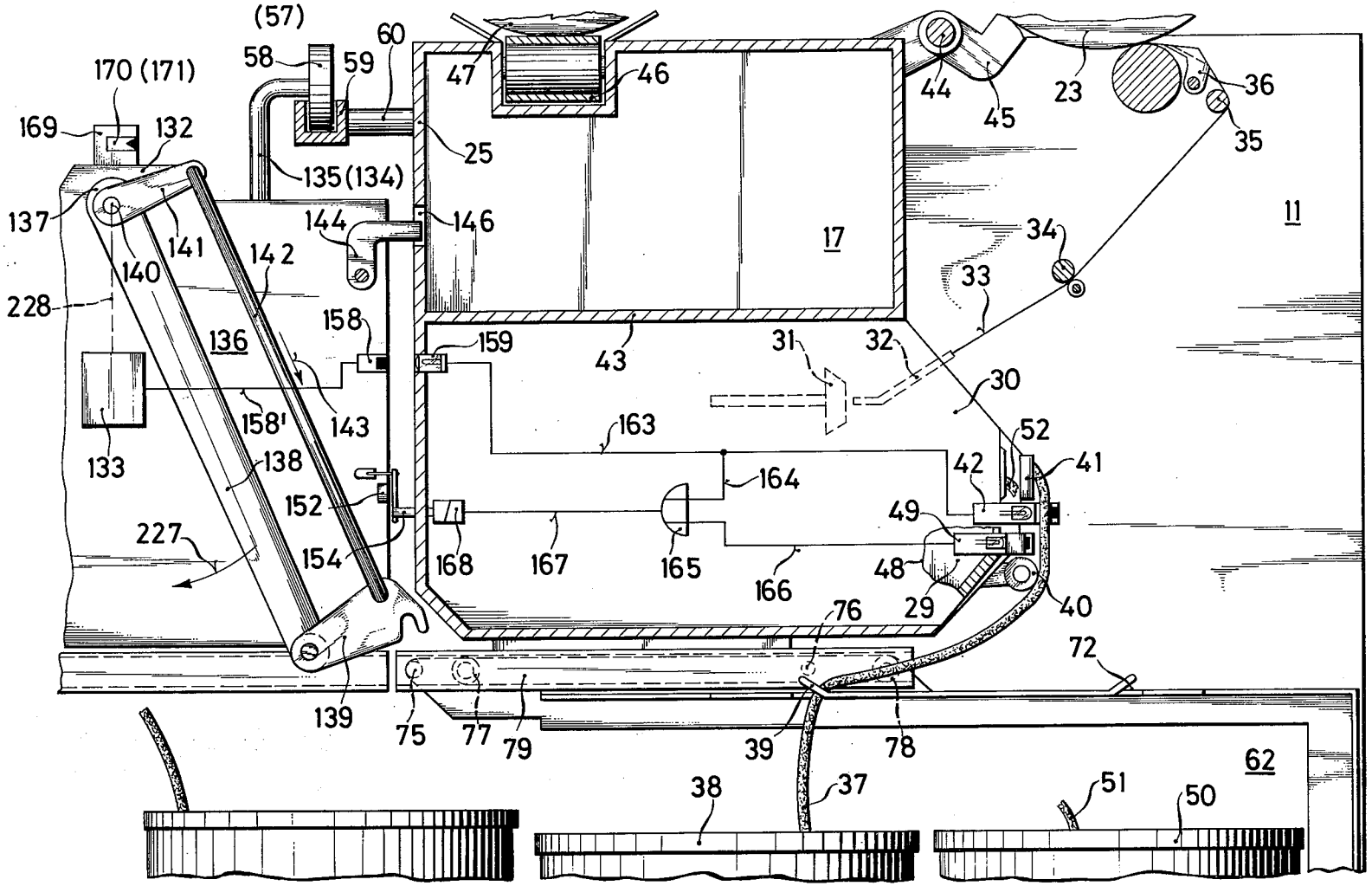
FIG. 3 is a fragmentary side elevational view, partly schematic of FIG. 2 as seen from the right-hand side thereof.

Referring now to the drawing and first, particularly to FIG. 1 thereof, there are shown individual spinning stations 12, 13, 14, 15, 16 and 17 of a spinning machine 11. The yarn spun at these spinning stations 12 through 17 is wound into cross-wound coils or cheeses 18, 19, 20, 21, 22 and 23, respectively. One cross-wound coil is associated with each spinning station. A common winding cylinder or roller 24 serves as friction drive for all of the cross-wound coils 18 through 23. Parts of the spinning device 11 proper are shown only in FIGS. 2 and 3. In FIG. 2, housings 27, 28, 29 and 30 of the spinning devices of the spinning stations 14 to 17 are seen behind a rear wall 25. In FIG. 3, the housing 30 of the spinning device of the spinning sation 17 can be seen. In this housing 30, a spinning rotor 31 and a thread withdrawal tube 32 are visible.

A spun thread 33 is withdrawn from the spinning rotor 31 at constant velocity by a take-up or drawing-off device 34, is guided over a roller 35, reciprocating traversed by a thread guide 36 and wound on the cross-wound coil or cheese 23 into a winding with crossed layers of thread.

It is apparent especially from FIG. 3, the sliver 37 which is to be spun is fed from a sliver container 38 over a sliver guide 39 and a roller 40 to an inlet opening 41 of the housing 30 of the spinning station 17. Between the roller 40 and the inlet opening 41, a reflection photoelectric device 42 for monitoring the sliver is disposed.

In FIG. 3, there is additionally seen a machine frame 43 of the spinning machine 11, a coil holder 45 pivoted in a joint 44 secured to the frame 43 and a conveyor belt 46 for fully wound cross-wound coils or cheeses. This conveyor belt 46, with a cross-wound coil 47 disposed thereon, is also shown in FIG. 1. FIG. 3 is partly broken away at 48 to show the housing 29 of the spinning device of the spinning station 16 and the reflection photoelectric device 49 fastened to that housing 29. The sliver container 50, the sliver 51 of which is shown severed in FIG. 3, is associated with the spinning station 16. The other end 52 of the severed or torn sliver 51 has already passed the reflection photoelectric device 49.

It is further apparent in FIG. 1 that a transporting device 53 is disposed for traveling along the spinning machine 11 on the rear side thereof. This transporting device 53 is track-bound i.e. is constrained to travel along a given travel path. It runs on a floor rail 56 by means of rollers 54 and 55 and is guided by rollers 57 and 58 traveling along a guide rail 59. The guide rail 59 is mounted on the rear wall 25 of the spinning machine 11 by means of supports 60.

The floor track 56 rests on metal ties 61. The ties 61 are extended so as to underlie the spinning machine 11 and serve simultaneously as rails or tracks for flat cars on which the sliver containers stand. In FIG. 1, a car or carriage 62 assigned to the spinning stations 16 and 17 and carrying the sliver containers 38 and 50 is shown. One car or carriage is provided for every two spinning stations, but in the interest of clarity, all of the cars or carriages are not shown. In FIG. 1, only some sliver containers are indicated i.e. the sliver containers 63, 64 and 65, of which the sliver container 65 is associated with the spinning station 13. In FIG. 2, there are shown additionally shown the sliver container 66 belonging to the spinning station 15 and the sliver container 67 belonging to the spinning station 14. The sliver containers 67 and 68 stand on the car or carriage 68. Each car or carriage has a frame 69, a front bumper 70, a lateral bumper 71, two sliver guides 72 and 73, a guide strip 74 with two posts 75 and 76 and two guide rollers 77 and 78, which are rollable in guide rails 79, 80, 81 and 82. In addition, each car or carriage has four identical flanged rollers 83, by means of which it can run on the ties 61.

Particularly from FIG. 1, it can be seen that the transporting device 53 has a frame 84 joined together from tubing, to which additional parts are fastened. Near the floor, the frame 84 carries, with the aid of struts or bars 85 and 86, a storage plate or platform 87 for exchanged sliver containers. Another, somewhat elevated storage platform 88 is provided to receive full sliver containers. In FIG. 1, this storage platform 88 carries the full sliver containers 89 and 90. Above these two sliver containers 89 and 90, an endless belt 91 is disposed which is looped around rollers 92 and 93. The roller 93 is rotatable by a toothed or serrated belt 94. The serrated belt 94 can be set in motion by a transmission system 95. The transmission system 95 is drivable by a transmission motor 96.

To the endless belt 91, there are fastened, above the sliver containers 89 and 90, two resilient sliver clamps 97 and 98, which have opening levers 99 and 100 that then extend into the operating or working range of a transfer device 101 if the endless belt 91 has advanced an adequate distance in direction of the arrow 102. The transfer device 101 has a transfer lever 103, which also carries a sliver clamp 103' at an end thereof, and is controllable through the transmission system 95 by a rod 104, a lever 105 and a shaft 106. The transfer device 101 also has a clamp opener 107 which is controllable likewise through the transmission system 95, by means of a rod 108 and a lever 109. The sliver clamp 97, according to FIG. 1, holds the starting end 110 of one sliver and the sliver clamp 98, the starting end 111 of another sliver.

Figure 5:
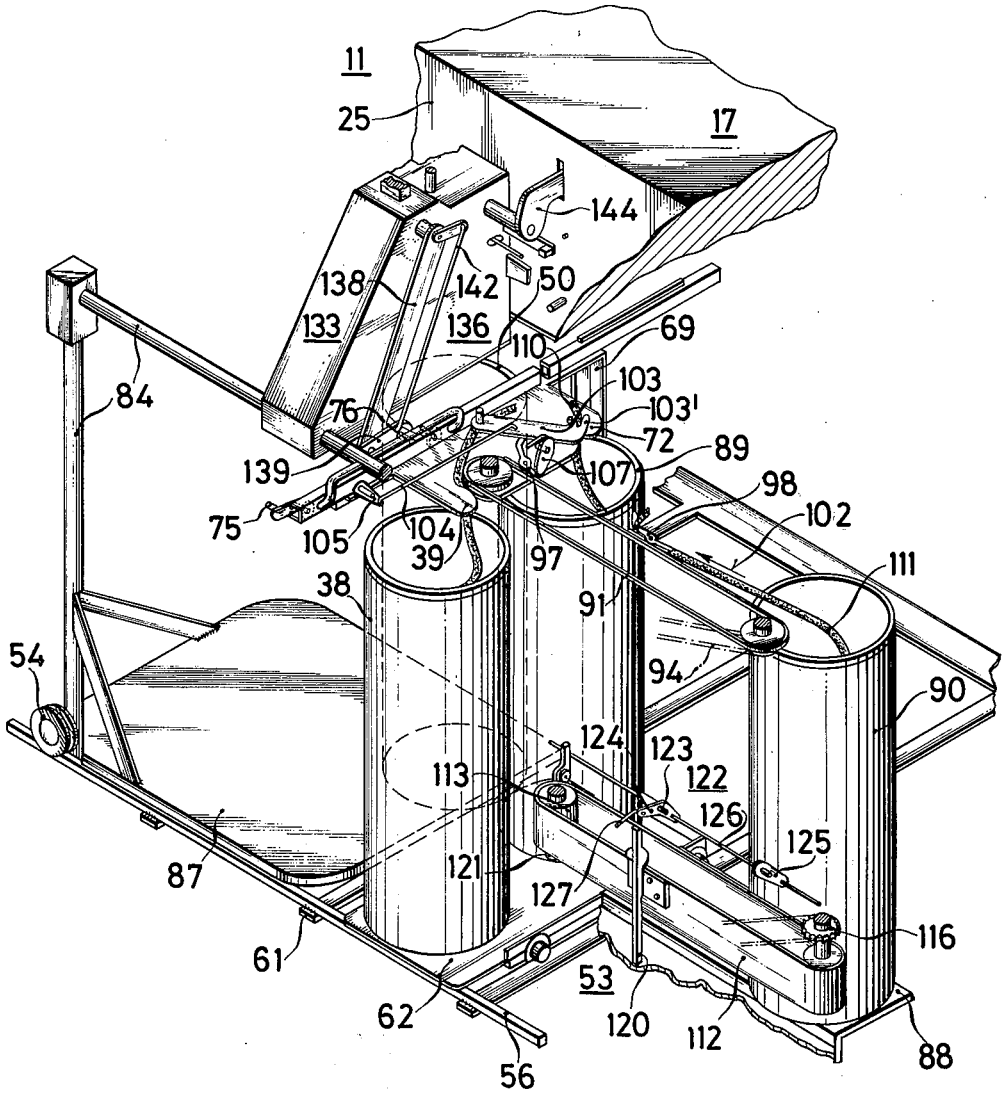

It is apparent from FIG. 1 that a container conveyor belt 112 is installed above the storage plate or platform 88. The container conveyor belt 112 is looped around the two belt rollers 113 and 114. The shaft 115 of the belt roller 114 carries a gear 116 which is drivable by means of a toothed or serrated belt 119 through a transmission 118. The transmission 118 has a drive motor 119. As is shown particularly clearly in FIG. 5, hinged or pivotable levers 120 and 121 are articulatingly secured to the container conveyor belt 112. These hinged or pivotable levers 120 and 121 are pivotable through about 90 degrees and are vertically disposed in rest or neutral position thereof, as shown in FIG. 5. Through a swinging or pivoting device 122, the hinged levers 120 and 121 are swingable into entraining position, as shown in FIG. 1. The swinging device 122 is formed of a shaft 123 supported in the frame 84. Two levers 124 and 125 to which a rod 126 is rigidly connected are secured to the swinging device 122. The lever 124 is a bell-crank lever and is articulatingly linked through a rod 127 to a lever 128 of the transmission 118. If the shaft 123 is swung or pivoted in direction of the arrow 129, the rod 126 loses the contact thereof with the dogs or noses 130 and 131 of the hinged or pivotable levers 120 and 121, whereby the hinged or pivotable levers are returned to the rest or neutral position thereof. The lever 128 has a non-illustrated cam control in the transmission 118.

The frame 84 of the transporting device 53 additionally carries a housing 132 of a switching or control device 133. To the housing 132 are connected supports 134 and 135 of rollers 57 and 58. The switching or control device 133 is associated with a shifting device 136 for the car or carriage 62. The shifting device 136 has an extension or pull-out lever 138, which is connected to a hollow shaft 137 and to the end of which an intercepting latch 139 is articulatingly secured. In the hollow shaft 137, there is mounted a shaft 140, to which a lever 141 is fastened. The lever 141 is articulatingly connected by a control rod 142 to the intercepting latch 139. As can be seen particularly from FIGS. 1 and 3, the intercepting latch 139 engages with a pin 75 of the guide rail 79 of the car or carriage 62 when the control rod 142 moves in direction of the arrow 143.

With the switching or control device 133, there is further associated a detent lever 144, which is fastened on a shaft 145. It can be seen from FIGS. 1 and 3 that the detent lever 144 engages in a detent 146. The detent 146 is associated with the spinning stations 16 and 17. Additional detents can be seen in the rear wall 25, as shown in FIG. 1. A detent 147 is associated with the spinning stations 14 and 15, and a detent 148 with the spinning stations 12 and 13. A detent 149 is associated with the next two non-illustrated spinning stations. Since the transporting device 53 is engaged with a detent lever 144 thereof at the spinning stations 16 and 17, the guide rail 150 attached to the frame 84 is aligned with the guide rail 79 of the car or carriage 62.

The engagement of the detent lever 144 is caused by a releasing lever 151, which is likewise associated with the switching or control device 133. The releasing lever 151 is rotatably fastened to an arm 152 and articulatingly connected to a release rod 153. As soon as the releasing lever 151 runs against one of a number of plungers 154 to 156 which are disposed at the rear wall 25 and are outwardly drivable electromagnetically, the releasing rod 153 is shifted from the rest or neutral position thereof and thereby initiates, by means of a non-illustrated conventional programming mechanism which is associated with the switching or control device 133, the engagement of the detent lever 144 and the activities of the transporting device 53 which are required for exchanging or replacing a sliver container and are described hereinafter in detail. A plunger is associated with every two spinning stations and, in fact, according to FIG. 1, the plunger 156 is associated with the spinning stations 12 and 13, the plunger 155 with the spinning stations 14 and 15, and the plunger 154 with the spinning stations 16 and 17. The latter plunger 154 has, in fact, just signalled a break of the sliver at one of these two spinning stations 16 and 17, because the plungers are driven outwardly only in the event of a sliver break, as will be explained in greater detail hereinbelow.

At the housing 132, there are seen a support 157 with an initiator 158. The initiator 158 reacts to signal transmittors 159, 160, 161 and 162 which are disposed in the rear wall 25. Such a signal transmitter 159 to 162 is associated with every spinning station having an uneven number, for example, the signal transmitter 159 with the spinning station 17, the signal transmitter 160 with the spinning station 15, and the signal transmitter 161 with the spinning station 13. The signal transmitter 159 to 162 report or signal a sliver break that might occur at the associated spinning station. For this purpose, the sliver is monitored at each spinning station; at the spinning station 17, for example, by the reflection-photographic device 42 and at the spinning station 16 by the reflection-photoelectric device 49 (FIG. 3).

According to FIG. 3, a line 163 leads from the photoelectric device 42 to the signal transmitter 159. From the line 163, a branch leads to the input 164 of an OR gate 165. The other input 166 of the OR gate 165 is connected to the photoelectric device 49. From the output of the OR gate 165, a line 167 leads to the electromagnetic actuator or drive 168 of the plunger 154. Similar circuit arrangements are provided for the plungers and signal transmitters of the other pairs of spinning stations.

Figure 6:
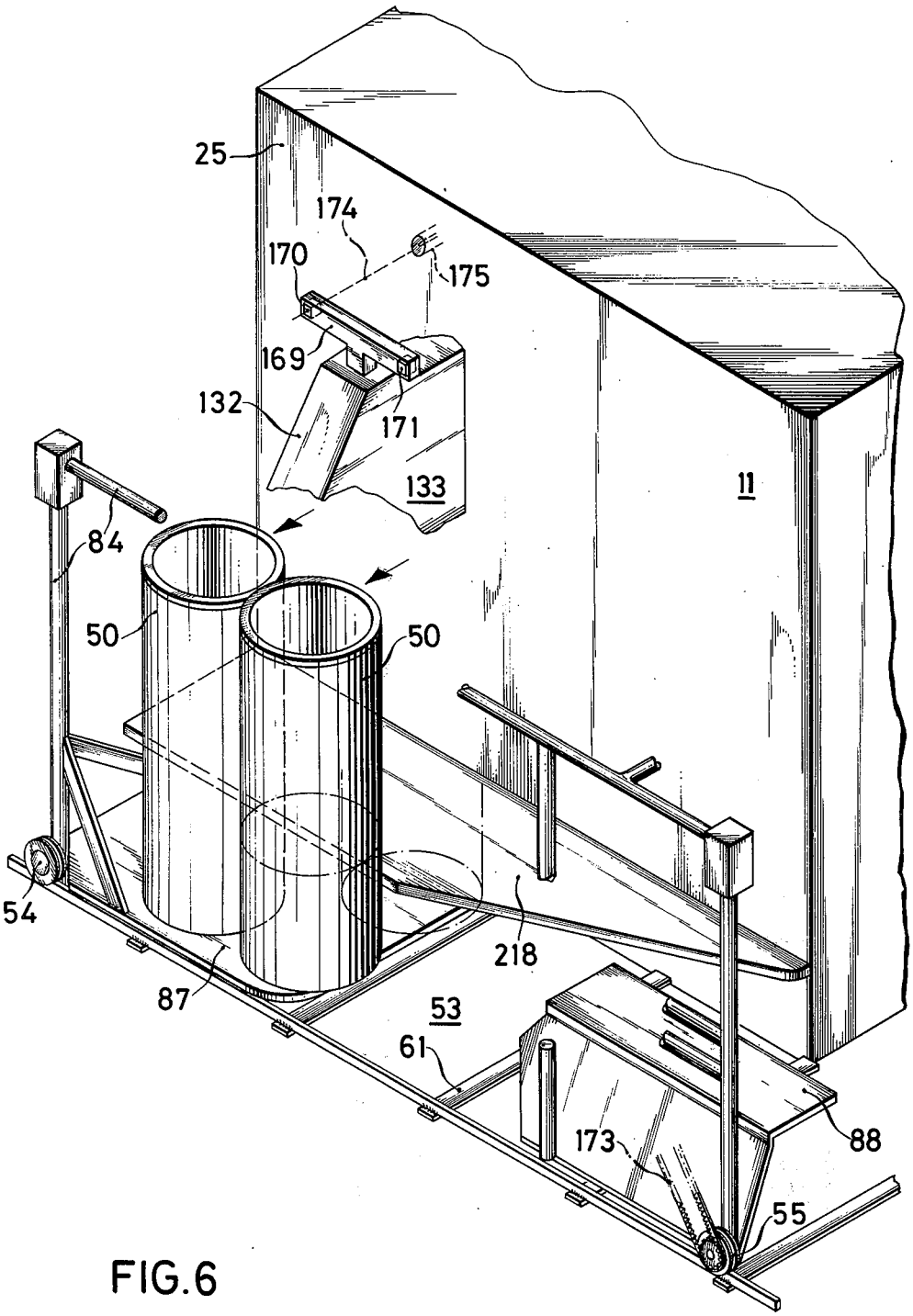

In an extension 169 of the housing 132, there are two further initiators 170 and 171 for initiating a reversal of the direction of rotation of the roller 55, which is connected to a gear 172 that is drivable selectively clockwise or counterclockwise through the transmission 118 by means of a serrated or toothed belt 173. When the transporting device 53 has arrived, as shown in FIG. 6, at the end of its track or travel path, the initiator 170 comes into the working range of a light beam 174, which emanates from a light source located in the rear wall 25, whereupon the direction of the roller 55 is caused to reverse in a hereinafter described manner. At the other end of the track or travel path of the transporting device 53, two switchable light sources 176 and 178 are provided in the rear wall, in accordance with FIG. 8. Only one of the two light sources is switched on. Switch-over of the light sources 176 and 178 is undertaken by a container feeler or sensor 178 also fastened on the rear wall 25. When the transporting device 53 arrives in direction of the arrow 179, the container sensor 178 initially ascertains if at least one sliver container remains on the storage plate or platform 88. If this is the case, the container sensor 178 causes the light source 176 to be switched on. As soon as the initiator 171, during further travel of the transporting device 53, comes into the working range of the light beam 182 emanating from the light source 176, the roller 55 is immediately caused to reverse its direction of rotation.

If the container sensor 178 has determined, however, that there is no longer any sliver container on the storage plate or platform 88, it causes the light source 177, as well as an electromagnet 183 attached at the rear wall 25, to be switched on. The electromagnet 183 then draws a detent latch 184 into the detent position shown in FIG. 7. Since the light source 176 is switched off, the transporting device 53 travels farther into the position thereof shown in FIG. 7 i.e. until the initiator 171 comes into the working range of the light beam 182' emanating from the light source 177. The initiator 171 now does not cause the transporting device 53 to return, but rather starts the loading with full sliver containers by a loading station 185. At the same time, the detent lever 192 of the of the transporting device 53 engages with the detent latch 184. As can be seen from FIGS. 7 and 8, the loading station 185 has a gravity-roller conveyor 186 with an inclined part 187 and a horizontal part 188. The horizontal part of the gravity-roller conveyor 186 has two rows of very short rollers, which leave a space, into which the storage plate of platform 88 of the transporting device 53 can travel. As is apparent from FIG. 8, the sliver container 189 is located on the inclined part 187, the sliver container 190 on the horizontal part 188, and the sliver container 191 also on the horizontal part 188 of the gravity-roller conveyor 186, but at the same time already on the storage plate or platform 88 of the transporting device 53, which is just leaving the loading station 185.

Figure 8:
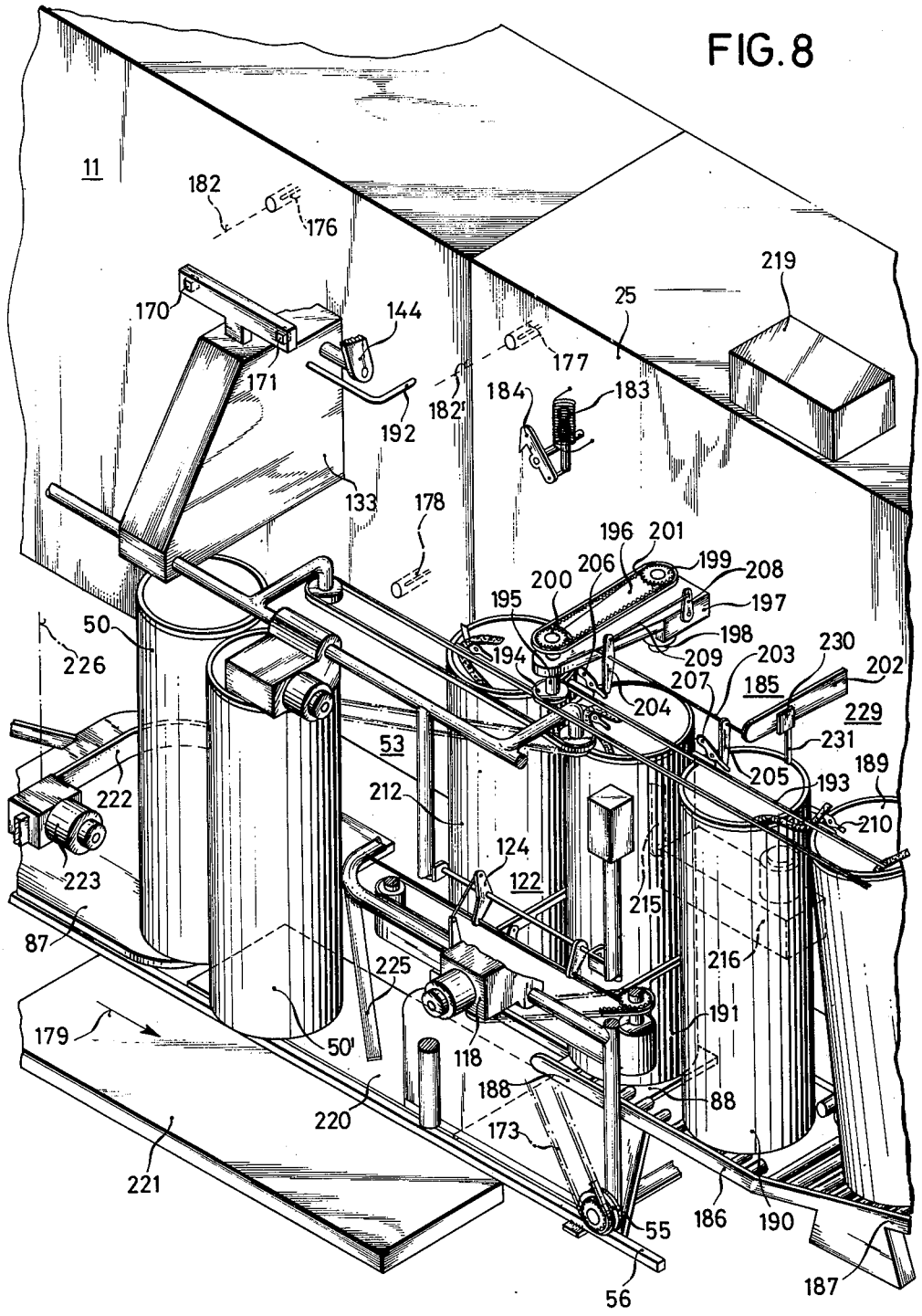

Above the sliver containers standing on the gravity-roller conveyor 188, an endless belt 193 is disposed looped or slung around two rollers or pulleys, of which only one pulley or roller 194 is visible in FIG. 8. A shaft 195 of the pulley 194 is mounted in a bracket 196, which is attached to the rear wall 25.

At the bracket 196, there is also secured a transmission 197 which has a transmission motor 198. Through the transmission 197 a gear 199 is driven. Another gear 200 is fastened on the shaft 195. A serrated or toothed belt 201 connects both gears 199 and 200.

In the bracket 196 and a further bracket 202, a shaft 203 is mounted, a two-arm lever 204 and a one-arm lever 205 being fastened to the shaft 203. The levers 204 and 205 serve for opening the sliver clamps 206, 207 and 210 which are fastened at the belt 193 at a spacing of one container from one another. The levers 204 and 205 are moved by a transmission lever 208, which is articulatingly connected to the two-armed lever 204 by a pull rod 209. According to FIG. 7, the sliver starting end 211 of the sliver container 212 is held by the sliver clamp 206, the sliver starting end 213 of the sliver container 191 by the sliver clamp 207, and the sliver starting end 214 of the sliver container 190 by the sliver clamp 210.

The loading station 185 has a blocking bracket 215, which prevents the sliver containers from rolling off the gravity-roller conveyor 186. When the transporting device 53 is loaded, however, the blocking bracket or lever 215 is swung upwardly, as indicated by the broken lines in FIG. 8. The swinging of the blocking bracket, 215 is effected by a transmission 216, which has a transmission motor 217 shown only in broken lines in FIGS. 7 and 8 because it is hidden therein by the sliver containers 189, 190, 191 and 212. Belonging to the loading station 185 is also a pivotable stripper arm 222 which is movable by a positioning motor or servomotor 223. The positioning motor 223 is fastened to a crosspiece or traverse 215'.

To describe an operating cycle, it is assumed that, in accordance with FIG. 3, the fiber sliver 51 has, in fact, just broken at the spinning station 16. Upon the break of the sliver 51, the reflection-photoelectric device 49 has responded, and the electromagnetic actuator or drive 168 has been switched-on through the OR-gate 165, so that the plunger 154 is driven outwardly, as shown in FIG. 3.

Figure 4:
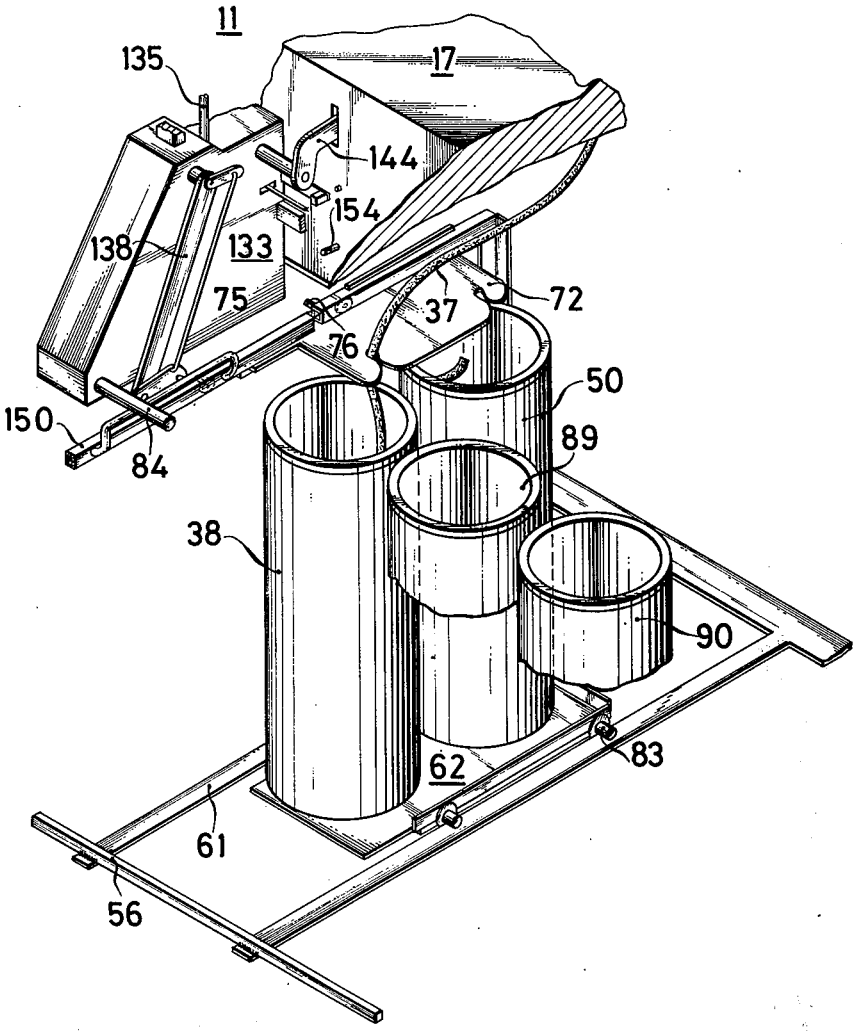
FIGS. 4 through 8 are fragmentary views of FIG. 1 in various different phases of operation of the device of the invention.

According to FIG. 1, the transporting device 53 loaded with the sliver containers 39 and 90 was, in fact, traveling in direction of the arrow 179. After the release lever 151 has struck the plunger 154, the release rod 153 was moved out of the rest or neutral position thereof and thereby, through a further nonillustrated, conventional programming mechanism which is associated with the switching or control device 133, engagement of the detent lever 144 into the detent 144 was initiated. This can be accomplished, for example, by mechanical means. According to FIG. 3, for example, there is an operating connection 228 from the switching or control device 133 to the hollow shaft 137 and to the shaft 140 of the shifting device 136. According to the program, the shifting device 136 executes two step-by-step switching operations. In the first stepwise switching operation, the control rod 142 is moved in direction of the arrow 143 until the intercept latch 139 engages behind the pin 75 of the guide rail 79 of the car or carriage 62. Then, the pull-out lever 138 is moved in direction of the arrow 227, whereby the car or carriage 62 rolls into the position shown in FIG. 4. The fiber sliver 37 continues to travel without interruption into the inlet opening 41 of the spinning station 17. The associated fiber sliver container 38 thus stands aligned with the sliver containers 89 and 90 maintained on hand on the storage platform or plate 88 of the transporting device 53. The control rod 142 is then moved in a direction opposite that indicated by the arrow 143 (FIG. 3). At the same time, the pull-out lever 138 is moved back in a direction opposite the direction represented by the arrow 227, the intercepting latch 139 rotating in cranklike manner about the stationary pin 75 and being thereby disengaged from the pin 75. In the second stepwise switching operation, the intercepting latch 139 engages behind the pin 76 of the same guide rail 79. With the following motion of the pull-out lever 138 in direction of the arrow 227, the car or carriage 62 is rolled up to the position thereof shown in FIG. 5. Thereafter, the transmission 118 is switched-on by the switching or control device 133 through a non-illustrated control line; the transmission 118 first rotates the shaft 123 in a rotary direction opposite that represented by the curved arrow 129, whereby the hinged or pivotable levers 120 and 121 are horizontally adjusted. Then, the container conveyor belt 112 is switched on, whereby the hinged or pivotable lever 121 shifts the sliver container 89 onto the car or carriage 62 forward of the sliver container 38, as shown in FIG. 5. The sliver container 89 shifts the fiber sliver container 50 ahead of it onto the storage plate or platform 87. At the same time, the switching or control device 133 switches-on the transmission 95 through a non-illustrated control line and, thereby, the endless belt 91 is moved in direction of the arrow 102. The fiber sliver clamp 97 with the sliver starting end 110 clamped therein follows the movement of the fiber sliver container 89. During the motion of the container conveyor belt 112, first, the hinged or pivotable lever 120 loses contact with the rod 126 of the swinging device 122 in the turn-around at the belt roller 113 and, subsequently, after the conveyor belt 112 has shifted, the fiber sliver container 89 onto the car or carriage 62, the hinged lever 121 also loses contact therewith. Both hinged or pivotable levers 120 and 121 assume the rest or neutral positions thereof sequentially, as shown in FIG. 5.

After the fiber sliver container 89 stands on the car or carriage 62, the transmission 95 turns the shaft 106 counterclockwise (as viewed in FIG. 1), the transfer lever 103 being thereby swung by the rod 104 so that the fiber sliver clamp 103' thereof grips the sliver starting end 110 below the sliver clamp 97 and firmly clamps it. Then, the transmission 95 moves the lever 109 clockwise, as viewed in FIG. 1, the clamp opener 108 being thereby shifted by means of the rod 108 against the opening lever 99 of the fiber sliver clamp 97 and thus opens the clamp. Upon swinging further, the transfer lever 103 transfers the fiber sliver starting end 110 to the sliver guide 72 of the spinning station 16. The instant of transfer can be seen in FIG. 5.

The return travel of the car or carriage 62 to the starting position thereof is accomplished by means of the shifting device 136, controlled by the programming mechanism of the switching or control device 133. During the return travel, two stepwise switching operations are necessary again. Initially, the pin 76 remains engaged in the intercepting latch 139, and the pull-out lever 138 swings in a direction opposite the direction represented by the curved arrow 227 to the position thereof indicated in FIG. 3. Then, the control rod 142 is moved in a direction opposite the direction represented by the arrow 143, in FIG. 3, whereby the intercepting latch 139 releases the pin 76. The pull-out lever 138 then swings in the direction of the arrow 227, the intercepting latch 139 engages the pin 75 after the control rod 142 is actuated, the pull-out lever 138 swings once more in direction opposite the direction represented by the arrow 227 and finally, the control rod 142 is drawn in a direction opposite the direction represented by the arrow 143, whereby the pin 75 is released again. This condition is shown in FIG. 3.

The transfer program has accordingly run its course, and the spinning station takes over the fiber sliver starting end 110 in a manner not shown in detail, since it forms no part of the invention of the instant application. As soon as the fiber sliver has passed the reflection photoelectric device 49, the input 166 of the OR-gate 165 receives a zero or O-signal, so that the magnetic actuator or drive 168 is deenergized, and the plunger 154 is thereby returned or driven back. In the process, the releasing lever 151 is switched back to the rest or neutral position thereof, whereby the disengagement of the detent lever 144 is caused by means of the switching or control device 133. At the same time, the switching or control device 133 causes the transporting device 53 to continue the travel thereof by switching the transmission 118 to cleared or free travel in the travel direction prevailing before the exchanging or replacing operation i.e. in the illustrated embodiment, in direction of the arrow 179.

With the aid of FIG. 3 of the drawing, it will be apparent that the operating or working cycle proceeds somewhat differently if the fiber sliver of a spinning station having an odd number e.g. the fiber sliver 37 of the spinning station 17, breaks or runs out. Then the plunger 154 is likewise driven out due to action of the reflection photoelectric device 42, the OR gate 165 and the electromagnetic actuator or drive 168, and the transporting device 53 is caused to stop at the group pair of spinning stations 16 and 17. At the same time, voltage is also applied, however, to the signal transmitter 159 through the line 163, so that the initiator 158 reacts and causes the switching or control device 133 to release, when the car or carriage is withdrawn, not two stepwise switching operations but, rather, only one. Otherwise, the individual operations proceed as described hereinabove.

After the transporting device 53 has given up one fiber sliver container of the storage supply thereof and accepted instead an empty sliver container, it travels back and forth, ready for operation, on the track or travel path thereof behind the spinning stations of the spinning machine. As soon as the initiator 170, at one end of the track or travel path, comes into the working range of the light beam 174 emanating from the light source 175, it causes the switching or control device 133 to reverse the direction of rotation of the roller 55. As may be seen from FIG. 6, there is at the end of the track or travel path, at the rear wall, an inclined diversion or deflection plate 218, which forces exchanged fiber sliver containers 50, 50', that may be on the storage plate or platform 87, into the position thereof shown in FIG. 6. The purpose of this measure is to provide for undisturbed unloading of the exchanged or replaced containers at the opposite end of the track or travel path.

If a container feeler or sensor 178 has determined, at the opposite end of the track or travel path, that there remains at least one fiber sliver container in the supply of the transporting device 53, and has therefore switched-on the light source 176, the initiator 171 causes the switching or control device 133 to initiate the reversal of the rotary direction of the roller 55, as soon as it comes into the working range of the light beam 182. However, if the container feeler or sensor 178 has determined than no filled fiber sliver container is in the supply any more, it then causes the light source 177 to be switched on, the light source 176 remaining switched off. Simultaneously, it causes the switching-on of the electromagnet 183 which places the detent latch 184 into detent-engaging position. The transporting device 53 thereby remains switched initially to continued travel in direction of the arrow 179.

The instant the intiator 171 then comes into the working range of the light beam 182' emitted by the light source 177 and the latch 184 simultaneously engages behind the detent lever 192, the switching or control device 133 is caused to stop the drive of the traveling transporting device 53 and to start the switching program for the operations of the following loading process which is yet to be described herein in detail. At the same time, the switching device 219 of the loading station 185 is caused to start the synchronous cycle of the operations assisting the loading process.

Figure 7:
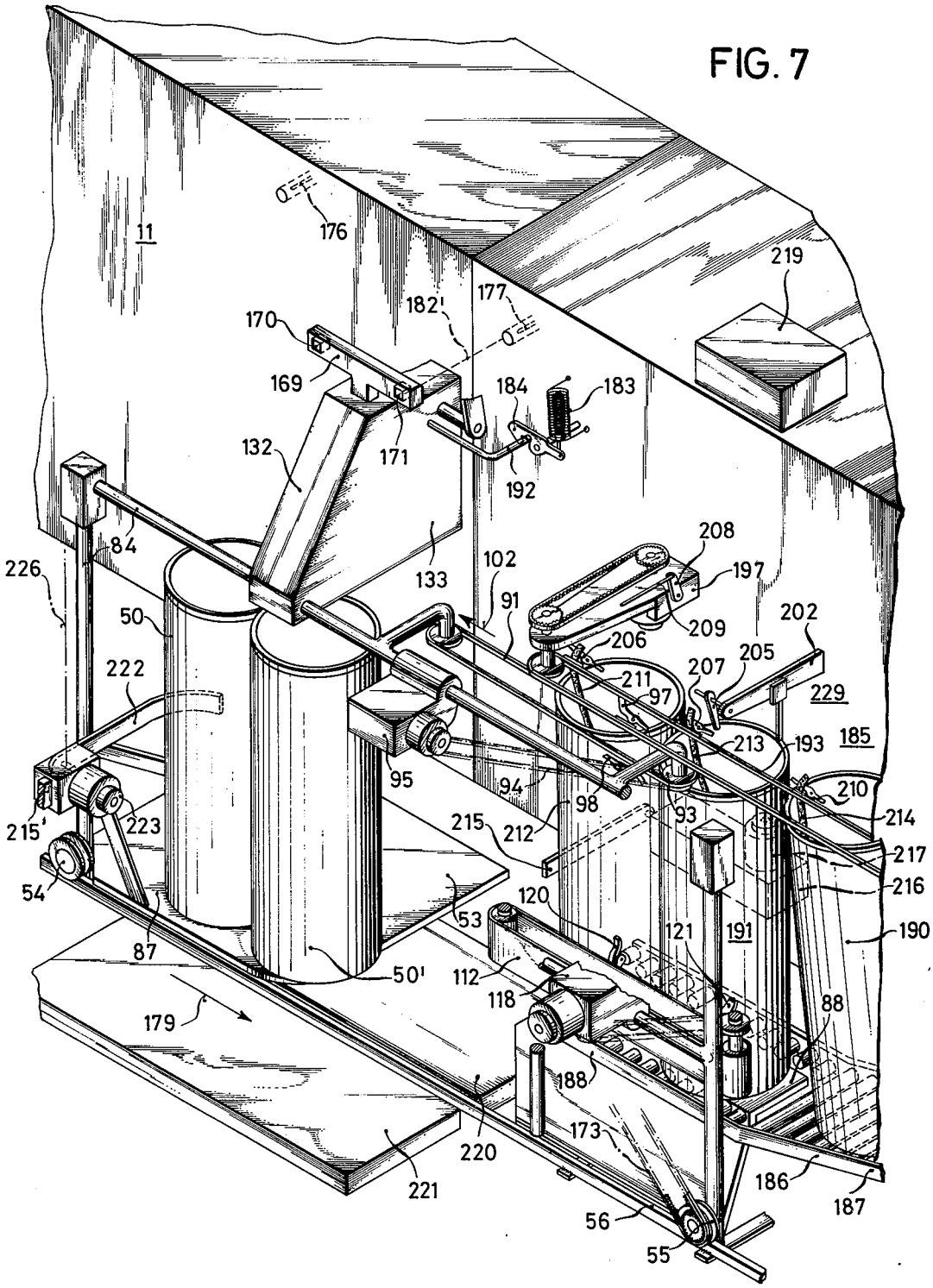

It is apparent from FIG. 7 that the transporting device 53 has already traveled to or arrived at the loading station 185. The storage plate or platform 88 has been shifted beneath the fiber sliver containers 191 and 192 standing ready on the horizontal part 188 of the roller conveyor 186, and has taken over both fiber sliver containers 191 and 192. The fiber sliver starting ends 211 and 213 of the fiber sliver containers 212 and 191 remain in the fiber sliver clamps 206 and 207 of the endless belt 193.

The switching or control device 219 now causes upward swinging of the blocking arm or bracket 215, which heretofore had prevented the fiber sliver containers from rolling off the roller conveyor 186. Simultaneously, the switching or control device 133 causes the transmission 118 to be switched on or activated, which moves the lever 128 (FIG. 1) clockwise, whereby the shaft 123 is turned by means of the rod 127 in direction opposite the rotary direction represented by the arrow 129. Due to the lowering of the rod 126, this results in the setting of the hinged or pivotable levers 120 and 121 into horizontal position. In this process, the hinged or pivotable lever 120 is pushed between the fiber sliver containers 191 and 212, and the hinged or pivotable lever 121 between the fiber sliver containers 190 and 191. Then, the transmission 118 sets the container conveyor belt 112 in operation, while the switching or control device 133, simultaneously causes the transmission 95 to be set into operation. By means of the toothed or serrated belt 94, the transmission 95 rotates the roller 93 of the endless belt 91, which is lower than the belt 193. In this process, the belt 91 and the fiber sliver clamps 97 and 98 connected therewith move a short distance in direction of the arrow 102, the fiber sliver clamp 97 gripping and clamping the fiber sliver end 211, and the fiber sliver clamp 98 gripping and clamping the fiber sliver end 213. Subsequently, the switching or control device 133 causes the departure of the transporting device 53 in direction opposite the direction represented by the arrow 179. In the interim, the switching or control device 219 has caused the transmission 197 to be switched on. The transmission 197 moves the transmission lever 208 first to the right, the levers 204 and 205 being adjusted by means of the pull rod 209 in such a manner that they open the fiber sliver clamps 206 and 207, as shown in FIG. 8. Simultaneously, the switching or control device 209 causes the positioning motor or servomotor 223 to be switched on, which puts the wiper or stripping arm 222 into the horizontal position shown in FIGS. 7 and 8.

Prior to the departure of the transporting device 53, the switching or control device 219 causes the electromagnet 183 to be deenergized, so that the detent latch 184 again releases the detent lever 192, as shown in FIG. 8. During further travel of the transporting device 53 from the position thereof shown in FIG. 8 in direction opposite the direction represented by the arrow 179, the two exchanged or replaced fiber sliver containers 50 and 50' are held back by the wiper or stripper arm 222 and, guided by a diversion or deflecting strip 225 of the transporting device 53, are shifted from the storage plate or platform 87, by means of a base plate 220 located behind the rail 56, onto a base plate 221 located in front of the rail 56. Immediately thereafter, the wiper or stipping arm 222 returns to the rest or neutral position thereof indicated by a dot-dash line 226. The storage plate or platform 87 is then free again to receive new exchanged or replaced fiber sliver containers.

After the departure of the transporting device 53, the switching or control device 219, after the transmission 216 is put in operation, causes the blocking lever or bracket 215 to be swung back into the horizontal blocking position thereof. The fiber sliver containers rolling further forward on the gravity-roller conveyor 186 then pass a device 229 for sensing the fullness of the respective container and for rejecting overfilled fiber sliver containers. The device 229 has a switch 230 which is mounted on the bracket 202 and has a feeler or sensor vane 231. The switch 230 is connected to the switching or control device 219 through a non-illustrated line. The instant the feeler vane 231 responds to a filling charge producing too high beyond the rim of the respective container, the switching or control device 219 received a signal from the switch 230 for blocking the blocking arm or bracket 215 and reporting the trouble. The blocking is cancelled only after the trouble is corrected by partially unloading or exchanging the overfilled container by operating personnel. As shown in FIG. 8, the fiber sliver container 190 is just passing the device 229.

At the same time with the forward rolling of the sliver containers, the endless belt 193 is set in motion by the switching or control device 219 through the transmission 197, so that the fiber sliver starting ends already clamped in the sliver clamps, travel along with the forward-rolling fiber sliver containers. This travel motion is programmed and, in the case at hand is not more than for a distance corresponding to two container widths.

There are claimed:

1. Method of replacing a sliver container in a spinning machine formed of a plurality of individual spinning stations, sliver containers being disposed in tandem in two rows, by means of a transporting device carrying a limited supply of the containers and being constrained to travel on a given travel path along the spinning machine, which comprises disposing at the spinning machine a respective pair of sliver containers in tandem on a carriage or slide movable transversely to the given travel path of the transporting device, loading the transporting device with filled sliver containers at one end of the spinning machine and unloading the transporting device of exchanged sliver containers at the same one end of the spinning machine or at the other end thereof, shuttling the transporting device back and forth, ready for operation, past the spinning stations of the spinning machine after the transporting device has been loaded with filled sliver containers, stopping the transporting device in front of a sliver container of a respective spinning station in response to a signal from the respective spinning station that sliver is missing from the respective sliver container and performing the following operations: drawing the carriage or slide up from a working station thereof to the level of the supply of containers on the transporting device, selecting the container with missing sliver that is to be replaced, replacing the container with missing sliver by a container filled with sliver, feeding a starting end of the sliver from the container filled with sliver to a sliver guide of the respective spinning station, returning the carriage or slide to the working station thereof, and resuming travel of the transporting device along the given travel path thereof.

2. Device for carrying out a method of replacing a sliver container in a spinning machine formed of a plurality of individual spinning stations, sliver containers being disposed in tandem in two rows, by means of a transporting device carrying a limited supply of the containers and being constrained to travel on a given travel path along the spinning machine, comprising carrying means disposed at the spinning machine for receiving thereof respective pairs of sliver containers disposed in tandem, said means being movable transversely to the given travel path of the transporting device.

3. Device according to claim 2 including shifting means on the transporting device for moving said container carrying means.

4. Device according to claim 2 including a loading station at one end of the spinning machine for loading filled sliver containers on the transporting device, and an unloading device at said one end of the spinning machine for unloading replaced containers from the transporting device.

5. Device according to claim 2 including a loading station at one end of the spinning machine for loading filled sliver containers on the transporting device, and an unloading device at the other end of the spinning machine for unloading replaced containers from the transporting device.

6. Device according to claim 5 including means at said loading station for sensing fullness of sliver in the respective containers and for rejecting overfilled sliver containers.

7. Device according to claim 2 including holding and transfer means on the transporting device for holding and transferring a starting end of a sliver to a sliver guide of a respective spinning station at which a sliver container is being replaced.

* * * * *